US008032042B2

(12) United States Patent
Fujii

(10) Patent No.: US 8,032,042 B2
(45) Date of Patent: Oct. 4, 2011

(54) DEVELOPING BIAS CONTROL DEVICE CAPABLE OF PROPERLY CONTROLLING DEVELOPING BIAS VOLTAGE

(75) Inventor: Koji Fujii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 443 days.

(21) Appl. No.: 12/392,157

(22) Filed: Feb. 25, 2009

(65) Prior Publication Data

US 2009/0220265 A1 Sep. 3, 2009

(30) Foreign Application Priority Data

Feb. 29, 2008 (JP) ..... 2008-050190

(51) Int. Cl.
*G03G 15/06* (2006.01)

(52) U.S. Cl. ..... 399/55

(58) Field of Classification Search ..... 399/37, 399/55, 88, 235, 270, 285
See application file for complete search history.

(56) References Cited

U.S. PATENT DOCUMENTS 6,999,707 B2 * 2/2006 Okamura ..... 399/285

FOREIGN PATENT DOCUMENTS

JP 2003066697 A 3/2003

* cited by examiner

*Primary Examiner* — David Gray
*Assistant Examiner* — Frederick Wenderoth
(74) *Attorney, Agent, or Firm* — Ditthavong Mori & Steiner, P.C.

(57) ABSTRACT

Upon receiving a request to control developing bias voltage, first and second square-wave signal output units output first and second square-wave signals, respectively. When a rising edge of the first square-wave signal coincides with a rising edge of the second square-wave signal, the rising edge of the second square-wave signal is advanced with respect to the rising edge of the first square-wave signal. When a falling edge of the first square-wave signal coincides with a falling edge of the second square-wave signal, the falling edge of the second square-wave signal is delayed with respect to the falling edge of the first square-wave signal. Subsequently, a voltage-controlling square-wave signal for controlling developing bias voltage is generated based on the first and second square-wave signals.

9 Claims, 5 Drawing Sheets

DEVELOPING BIAS CONTROL DEVICE CAPABLE OF PROPERLY CONTROLLING DEVELOPING BIAS VOLTAGE

BACKGROUND OF THE INVENTION

1. Field of the Invention

This invention relates to a developing bias control device, developing unit and image forming apparatus, and more particularly to a developing bias control device that controls developing bias voltage with software, and a developing unit and image forming apparatus having the developing bias control device.

2. Description of Background Art

A developing unit built in an image forming apparatus forms an image from scanned image data using a photo conductor and developer-supplying rotary component, such as a developing sleeve and magnetic roller, which is used to supply developer to the photo conductor, and transfers the formed image onto a piece of paper to output. In order to properly supply the developer to the photo conductor, a predetermined developing bias voltage is applied to the developing sleeve and magnetic roller.

As shown in FIG. 6, the conventional developing unit uses hardware such as circuitry to transmit a square-wave signal 103 from a main board 101 to a high voltage power supply 102 which is used to apply developing bias voltage to the developing sleeve and other components, thereby controlling the developing bias voltage. Specifically, a controller generates an interrupt to control developing bias voltage at changing points 104 of the output level of the square-wave signal 103, the changing points being defined as time to switch the developing bias voltage.

A technique relating to the developing bias voltage control is disclosed in Japanese unexamined patent publication No. 2003-66697. For the purpose of preventing overshooting and undershooting of the developing bias voltage at a switching time, the publication discloses a developing transformer connected to a Zener diode having a breakdown voltage set equal to the upper limit of the AC components of developing bias voltage and a varistor having a varistor voltage set equal to the lower limit of the AC components of the developing bias voltage.

With consideration given to image quality improvement, it is preferable that the duty ratio and output pattern of the square-wave signal can be changed freely. Because of this, the use of software to control the developing bias voltage is more preferable than conventional voltage control by hardware.

In the case where software is used to control the developing bias voltage, the following technique may be employed. First, a first square-wave signal that instructs output of a first level and second level and a second square-wave signal that instructs output of a third level between the first and second levels are output; the instruction of the second square-wave signal has higher priority than that of the first square-wave signal. Based on the two square-wave signals, a square-wave signal for controlling the developing bias voltage is generated and output to a high voltage power supply to control the developing bias voltage.

FIG. 7 shows the two square-wave signals and the voltage-controlling square-wave signal generated from the two square-wave signals. FIG. 7(*a*) is a schematic view of the first square-wave signal. The first square-wave signal 111*a* has a level 112*a* instructing output of a first level and a level 112*b* instructing output of a second level. FIG. 7(*b*) is a schematic view of the second square-wave signal. The second square-wave signal 111*b* has a level 112*c* instructing output of a third level. FIG. 7(*c*) is a schematic view of the square-wave signal 111*c* for controlling developing bias voltage, which is generated based on the first and second square-wave signals 111*a*, 111*b*.

Referring to FIG. 7, the voltage-controlling square-wave signal 111*c* generated based on the first and second square-wave signals 111*a*, 111*b* has a first level 113*a*, second level 113*b* and third level 113*c*. The third level 113*c* is a level between the first level 113*a* and second level 113*b*. The voltage-controlling square-wave signal 111*c* is generated by giving higher priority to the second square-wave signal 111*b* than the first square-wave signal 111*a*, more specifically, by giving higher priority to the level 112*c* than the level 112*a* when the level 112*a* of the first square-wave signal 111*a* coincides with the level 112*c* of the second square-wave signal 111*b*. The first and second square-wave signals 111*a*, 111*b* are output at right timing so that the voltage-controlling square-wave signal is shaped into a required waveform as shown in FIG. 7(*c*). In this description, the first and second square-wave signals 111*a*, 111*b* are output so that the level 112*a* and level 112*c* exhibit a perfect match, thereby intentionally generating the voltage-controlling square-wave signal 111*c* whose first level 113*a* does not occur in the vicinity of the third level 113*c*.

In the case of intentionally obtaining the voltage-controlling square-wave signal 111*c* shown in FIG. 7(*c*) from first and second square-wave signals 114*a*, 114*b* shown in FIG. 8(*a*) and 8(*b*), respectively, a little delay of the second square-wave signal 114*b* may delay the rising edge to a level 115*c* for time tx with respect to the rising edge to the level 115*a*. This generates a voltage-controlling square-wave signal 114*c*, as shown in FIG. 8(*c*), including a first level 116*a* equal to the time tx which is a delay time of the rising edge to the level 115*c*.

Accordingly, the first and second square-wave signals 114*a*, 114*b* output with a time lag result in an unintentional voltage-controlling square-wave signal 114*c* that includes an unintentional first level 116*a* combined with the front portion of the third level 116*b*. Proper control of the developing bias voltage is impossible with such a voltage-controlling square-wave signal having the unintentional output level, and therefore image quality may be deteriorated. Since the first and second square-wave signals are generated and activated by software, it is difficult to prevent the rise delay caused by the output timing of the first and second square-wave signals 114*a*, 114*b*.

SUMMARY OF THE INVENTION

An object of the present invention is to provide a developing bias control device capable of properly controlling developing bias voltage.

Another object of the present invention is to provide a developing unit capable of improving image quality.

Yet another object of the present invention is to provide an image forming apparatus capable of improving image quality.

Yet another object of the present invention is to provide a developing bias control method capable of properly controlling developing bias voltage.

The developing bias control device according to the present invention controls developing bias voltage by a square-wave signal having a first level, second level and third level between the first and second levels. The developing bias control device comprises a first square-wave signal output unit that outputs a first square-wave signal instructing output of the first and second levels, a second square-wave signal output unit that outputs a second square-wave signal instructing output of the third level, the instruction of the second square-wave signal having higher priority than that of the first square-wave signal, and a control unit that controls the first and second square-wave signal output units so as to advance a rising edge of the second square-wave signal with respect to a rising edge of the first square-wave signal when the rising edge of the first square-wave signal coincides with the rising edge of the second square-wave signal, and to delay a falling edge of the second square-wave signal with respect to a falling edge of the first square-wave signal when the falling edge of the first square-wave signal coincides with the falling edge of the second square-wave signal.

According to the invention, when the rising edge of the first square-wave signal coincides with the rising edge of the second square-wave signal, the second square-wave signal is raised before the first square-wave signal rises, and when the falling edge of the first square-wave signal coincides with the falling edge of the second square-wave signal, the second square-wave signal is dropped after the first square-wave signal falls. This can reduce the possibility of shaping the voltage-controlling square-wave signal, which is used to control developing bias voltage and has the first, second and third levels, into a unfavorable waveform, even though the rising edges and falling edges of the first and second square-wave signals are out of synchronization. Thus, the developing bias voltage can be properly controlled.

The developing unit according to another aspect of the present invention includes a developing bias control device and a developer-supplying rotary component that is controlled by the developing bias control device to supply developer.

The developing unit including the developing bias control device capable of properly controlling developing bias voltage can contribute to image quality improvement.

The image forming apparatus according to yet another aspect of the present invention comprises an image forming section that forms images from image data. The image forming section includes a developing unit that forms images with developer. The developing unit includes a developer-supplying rotary component that rotates to supply developer and a developing bias control device that controls developing bias voltage to be applied to the developer-supplying rotary component by a square-wave signal having a first level, second level and third level between the first and second levels. The developing bias control device includes: a first square-wave signal output unit that outputs a first square-wave signal instructing output of the first and second levels; a second square-wave signal output unit that outputs a second square-wave signal instructing output of the third level, the instruction of the second square-wave signal having higher priority than that of the first square-wave signal; and a control unit that controls the first and second square-wave signal output units so as to advance a rising edge of the second square-wave signal with respect to a rising edge of the first square-wave signal when the rising edge of the first square-wave signal coincides with the rising edge of the second square-wave signal, and to delay a falling edge of the second square-wave signal with respect to a falling edge of the first square-wave signal when the falling edge of the first square-wave signal coincides with the falling edge of the second square-wave signal.

The image forming apparatus including the developing bias control device capable of properly controlling the developing bias voltage can contribute to image quality improvement.

The developing bias control method according to yet another aspect of the present invention controls developing bias voltage to be applied to a developer-supplying rotary component by a square-wave signal having a first level, second level and third level between the first and second levels. The method comprises the steps of: receiving a request to control developing bias voltage; instructing output of the first and second levels by a first square-wave signal output from a first square-wave signal output unit; instructing output of the third level by a second square-wave signal output from a second square-wave signal output unit, the instruction of the second square-wave signal having higher priority than that of the first square-wave signal; controlling the first and second square-wave signal output units so as to advance a rising edge of the second square-wave signal with respect to a rising edge of the first square-wave signal when the rising edge of the first square-wave signal coincides with the rising edge of the second square-wave signal, and to delay a falling edge of the second square-wave signal with respect to a falling edge of the first square-wave signal when the falling edge of the first square-wave signal coincides with the falling edge of the second square-wave signal; generating a voltage-controlling square-wave signal for controlling the developing bias voltage based on the first and second square-wave signals; and outputting the generated voltage-controlling square-wave signal to a high voltage power supply to apply the developing bias voltage.

The developing bias control method can properly control the developing bias voltage.

DESCRIPTION OF PREFERRED EMBODIMENT

Figure 1:
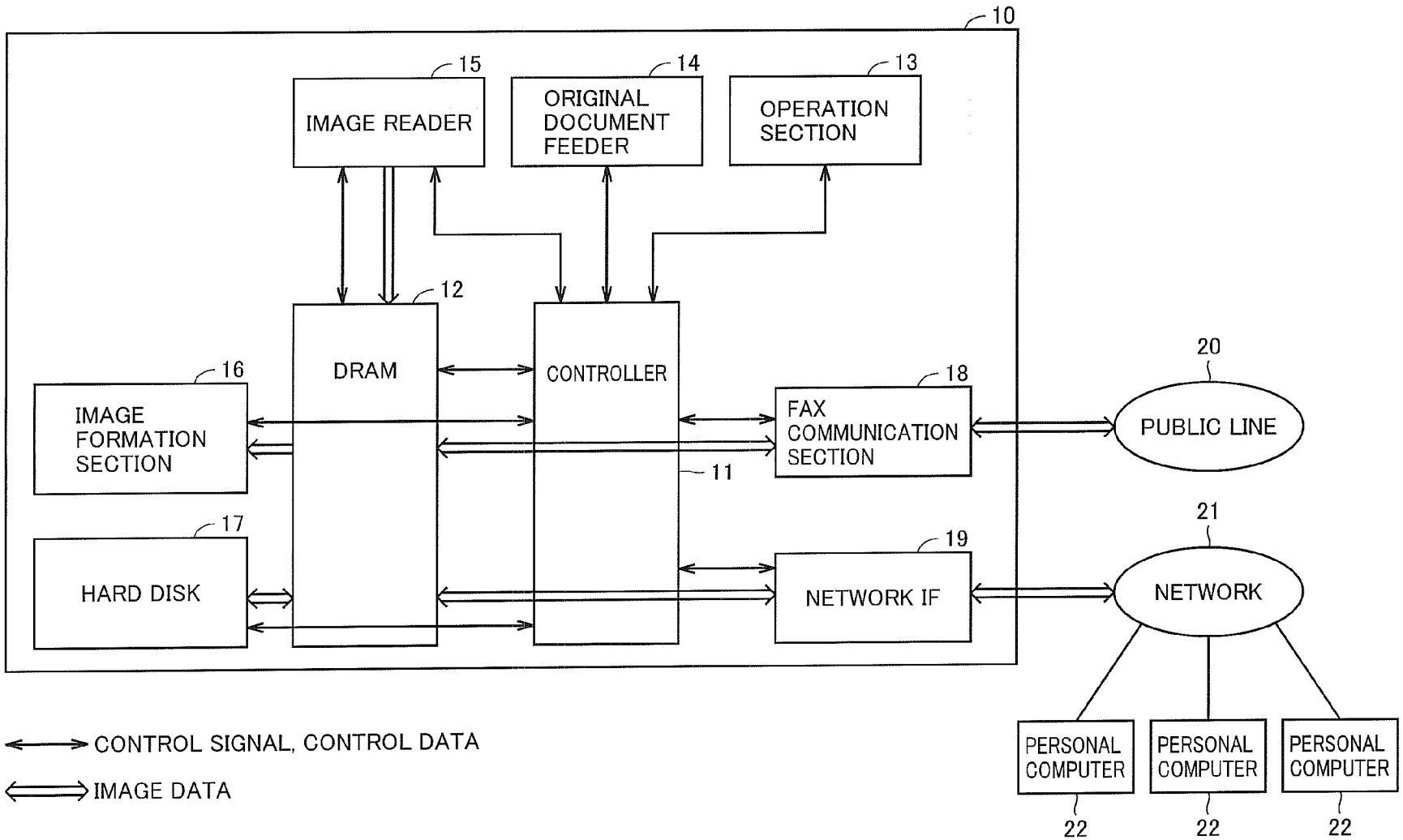
FIG. 1 is a block diagram showing the whole structure of a multifunctional printer provided with developing units each including a developing bias control device according to an embodiment of the present invention.

An embodiment of the present invention will be described below by referring to the drawings. FIG. 1 is a block diagram showing the structure of a multifunctional printer 10 to which an image forming apparatus including a developing unit provided with a developing bias control device according to the embodiment of the present invention is applied. Referring to FIG. 1, the multifunctional printer 10 includes a controller 11 that controls the entire multifunctional printer 10, a DRAM 12 that is used to write and read image data and other data, a display screen that displays data in the multifunctional printer 10, an operation section 13 that serves as an interface between the multifunctional printer 10 and users, an original document feeder 14 that automatically transfers an original to a predetermined original read position, an image reader 15 that reads the image of an original that is transferred to the predetermined original read position by the original document feeder 14, an image forming section 16 that forms an image based on the original read by the image reader 15, a hard disk 17 that stores image data and other data, a FAX communication section 18 connected to a public line 20 and a network IF (interface) 19 that is used to connect the multifunctional printer 10 and a network 21.

The controller 11 compresses and encodes original data fed by the image reader 15 to write the compressed encoded data into the DRAM 12, while reading out the written data in the DRAM 12 and decompressing and decoding the data to output to the image forming section 16.

When the multifunctional printer 10 operates as a copying machine, the multifunctional printer 10 forms an image in the image forming section 16 based on original image data which is read by the image reader 15 and sent through the DRAM 12. When the multifunctional printer 10 operates as a printer, the multifunctional printer 10 forms an image in the image forming section 16 based on original image data which is transmitted from the personal computers 22 connected to the network 21 through the network IF 19 and the DRAM 12. Furthermore, when the multifunctional printer 10 operates as a facsimile machine, the multifunctional printer 10 forms an image in the image forming section 16 based on image data transmitted from the public line 20 through the FAX communication section 18 and the DRAM 12, or the multifunctional printer 10 transmits original image data, which is read by the image reader 15, through the DRAM 12 and the FAX communication section 18 to the public line 20.

In FIG. 1, double-line arrows indicate flows of image data, while thin-line arrows indicate flows of control signals or control data.

Figure 2:
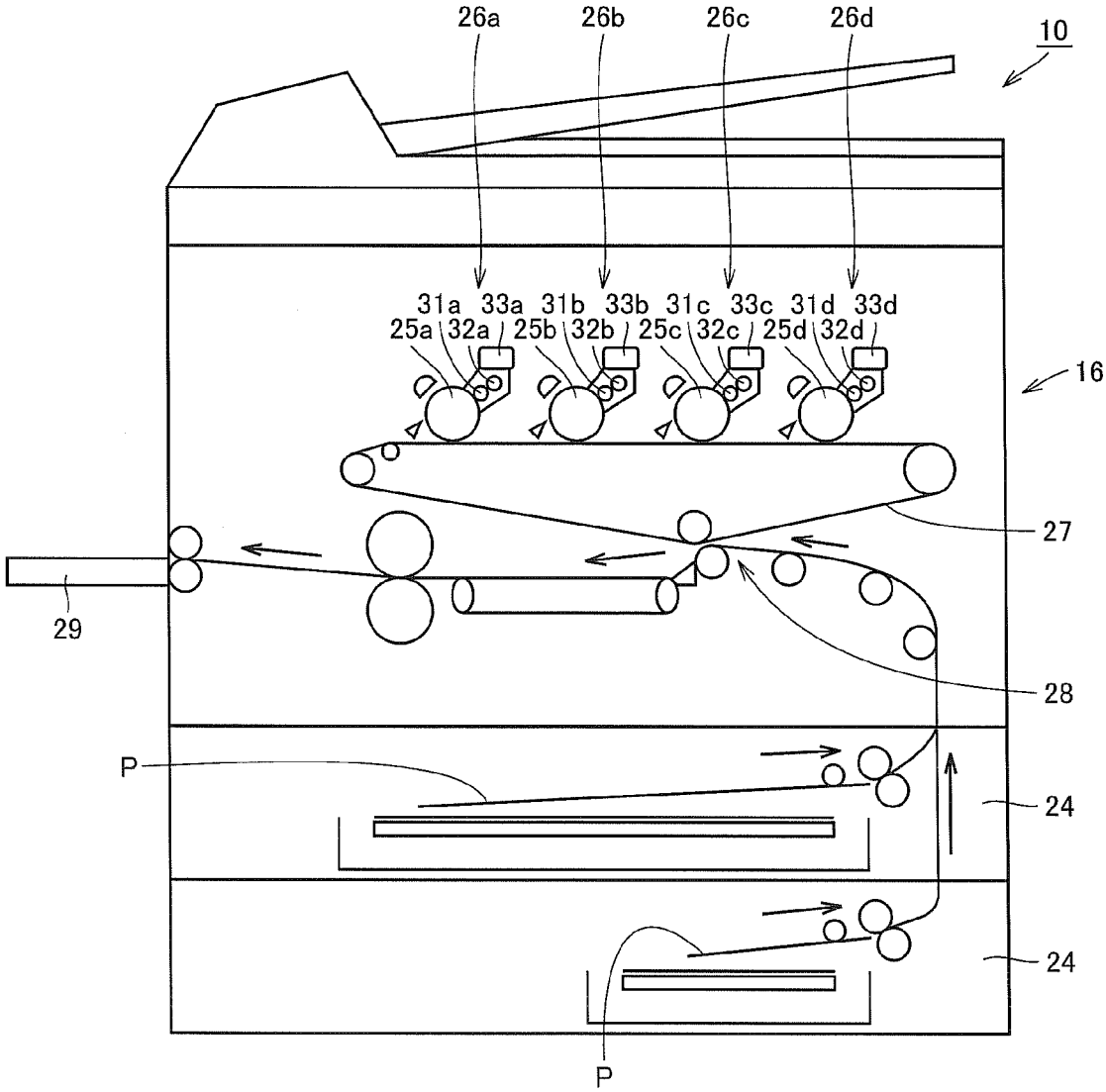
FIG. 2 is a schematic view of the multifunctional printer including the developing units.

Next, a description will be given about the structure of developing units included in the image forming section 16. FIG. 2 is a schematic view of the multifunctional printer 10 including the developing units. FIG. 2 depicts the flow of a piece of paper. Referring to FIGS. 1 and 2, the image forming section 16 capable of forming full-color images includes developing units 26*a*, 26*b*, 26*c* and 26*d* corresponding to four colors, i.e., yellow, cyan, magenta and black, respectively, and a transfer belt 27 serving as an intermediate transfer medium for transferring images of each color output from the respective developing units 26*a* to 26*d*.

The developing unit 26*a* operates on a 1.5-component development system and includes a developing sleeve 31*a* that supplies developer (not shown) to a photo conductor 25*a*, a magnetic roller 32*a* that supplies the developer to the developing sleeve 31*a* and a toner hopper 33*a* that dispenses the developer to the magnetic roller 32*a*. The developing sleeve 31*a* is placed proximate to the photo conductor 25*a*, the magnetic roller 32*a* is placed on the developing sleeve 31*a*, and the toner hopper 33*a* is placed above the magnetic roller 32*a*. The developer (toner) dispensed by the toner hopper 33*a* is fully agitated with a carrier on the magnetic roller 32*a* and then supplied to the developing sleeve 31*a* and the photo conductor 25*a* to be developed. Images are thus formed with the developer by the developing unit 26*a* in the image forming section 16. In this embodiment, the developing sleeve 31*a* and the magnetic roller 32*a* that supplies developer to the developing sleeve 31*a* are developer-supplying rotary components in the developing unit 26*a*.

The developing units 26*b* to 26*d* also include developing sleeves 31*b*, 31*c* and 31*d* that supply developer to photo conductors 25*b*, 25*c* and 25*d*, respectively, magnetic rollers 32*b*, 32*c* and 32*d* that supply the developer to the developing sleeves 31*b* to 31*d*, respectively, and toner hoppers 33*b*, 33*c* and 33*d* that dispense the developer to the magnetic rollers 32*b* to 32*d*, respectively. The structures of the developing units 26*b* to 26*d* are the same as that of the developing unit 26*a* and their descriptions will not be reiterated.

The images of each color formed by the respective developing units 26*a* to 26*d* are transferred in sequence so as to superimpose the images on the transfer belt 27. Superimposing the images of four colors creates a full-color image on the transfer belt 27. The developing sleeves 31*a* to 31*d* and magnetic rollers 32*a* to 32*d* are thus used to form full-color images. The full-color image formed on the transfer belt 27 is transferred on a piece of paper P which has been moved from a cassette 24 to a transferring section 28. The paper P with the full-color image transferred is output to an output tray 29 through a fixing section (not shown).

In order to form proper images, the developing sleeves 31*a* to 31*d* and magnetic rollers 32*a* to 32*d* provided in the respective developing units 26*a* to 26*d* are applied with a developing bias voltage from a high voltage power supply (not shown). Accordingly, each of the developing units 26*a* to 26*d* includes a developing bias control device (not shown) that is operated by software to control the developing bias voltage to be applied to the developing sleeves 31*a* to 31*d* and magnetic rollers 32*a* to 32*d* which are the developer-supplying rotary components for supplying developer.

Figure 3:
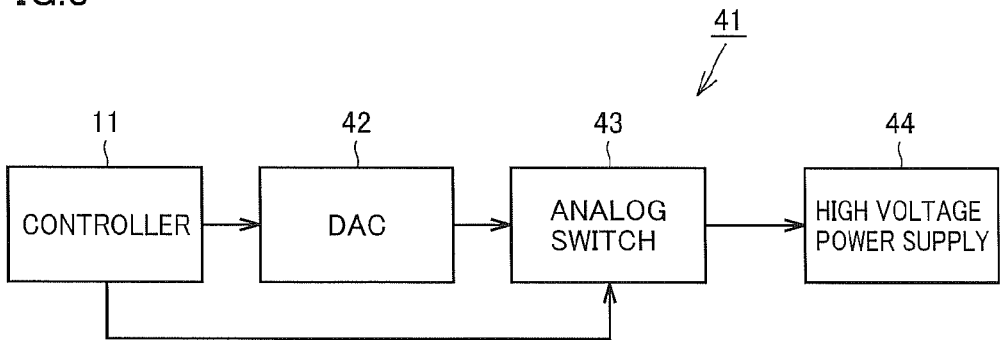
FIG. 3 is a block diagram showing a part of the developing bias control device.

FIG. 3 is a block diagram of the developing bias control device. FIG. 3 depicts the flow of a control signal or control data by arrows. Referring to FIG. 3, a developing bias control device 41 includes a controller 11 that generates signals to control the voltage to be output from a high voltage for a high voltage power supply, a DAC (Digital Analog Converter) 42 that converts digital signals into analog signals and outputs the converted signals, an analog switch 43 that is a switch of analog signals, and a high voltage power supply 44 that applies developing bias voltage to the developing sleeves 31*a* and other components based on a square-wave signal for controlling the developing bias voltage. The DAC 42 outputs levels corresponding to a first level, second level and third level, which will be described later, to channels, such as channel 0, channel 1 and channel 2, respectively.

The controller 11 uses a built-in timer array unit (not shown) to transmit output switching signals for the DAC 42 to the analog switch 43. These output switching signals are first and second square-wave signals, which will be described later. The analog switch 43 changes the output of the DAC 42 based on the output switching signals for the DAC 42 to output a voltage-controlling square-wave signal to the high voltage power supply 44. The DAC 42 and other components operate as first and second square-wave signal output units.

The developing bias control device 41 includes a first square-wave signal output unit that outputs a first square-wave signal instructing output of first and second levels, a second square-wave signal output unit that outputs a second square-wave signal instructing output of a third level, the instruction of the second square-wave signal having higher priority than that of the first square-wave signal, and a control unit that controls the first and second square-wave signal output units so as to advance a rising edge of the second square-wave signal with respect to a rising edge of the first square-wave signal when the rising edge of the first square-wave signal coincides with the rising edge of the second square-wave signal and to delay a falling edge of the second square-wave signal with respect to a falling edge of the first square-wave signal when the falling edge of the first square-wave signal coincides with the falling edge of the second square-wave signal. The developing bias control device 41 also includes a voltage-controlling square-wave signal generation unit that generates a square-wave signal for controlling the developing bias voltage based on the first and second square-wave signals.

Next, a description will be given about the control of developing bias voltage made for the developing sleeve 31*a* in the developing unit 26*a*.

Figure 4:
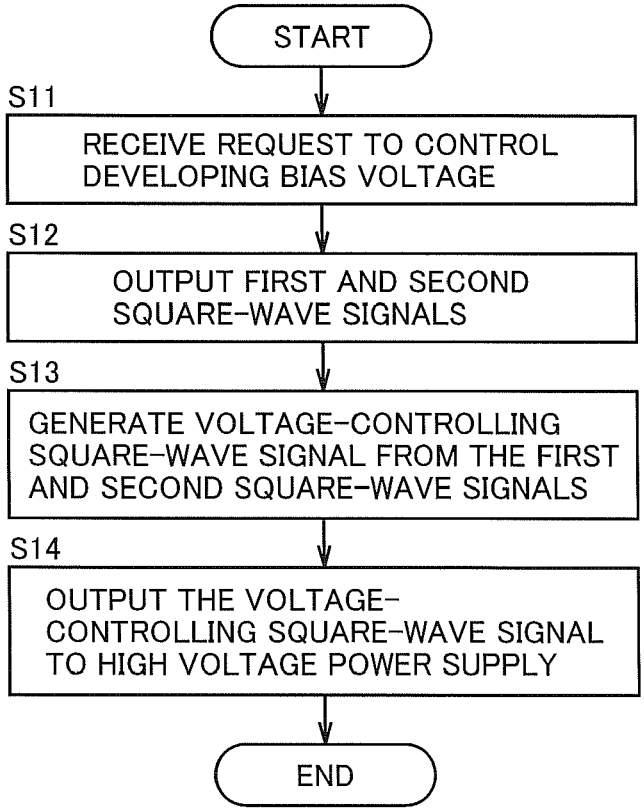
FIG. 4 is a flow chart showing operations for controlling developing bias voltage.
Figure 5:
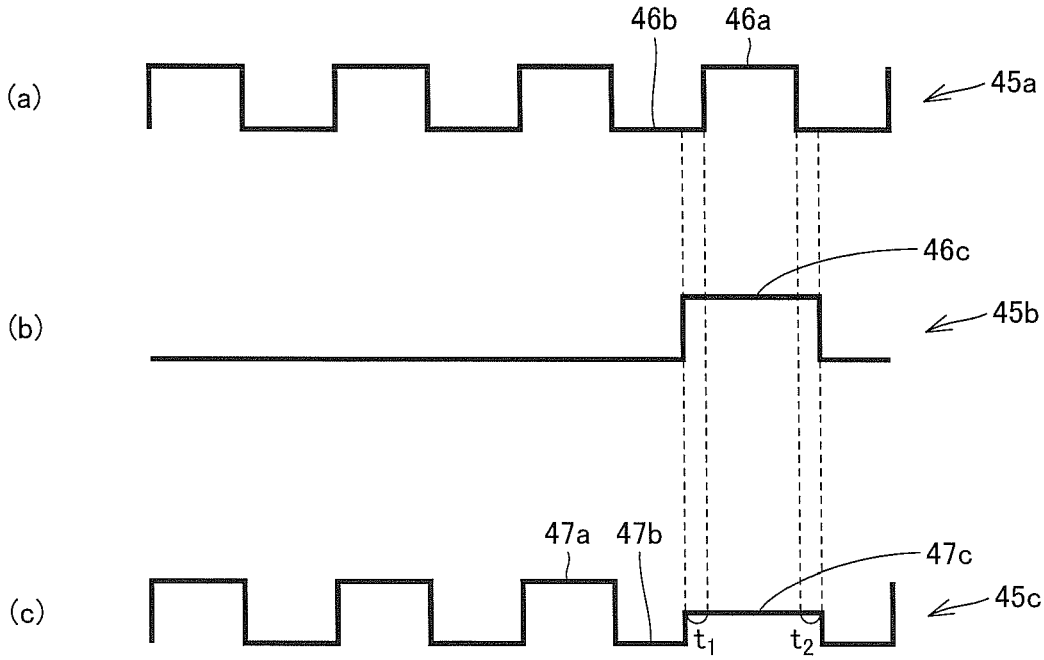
FIG. 5 illustrates (a) a first square-wave signal, (b) a second square-wave signal and (c) a voltage-controlling square-wave signal, respectively, which are output by the developing bias control device according to the embodiment of the invention.
Figure 6:
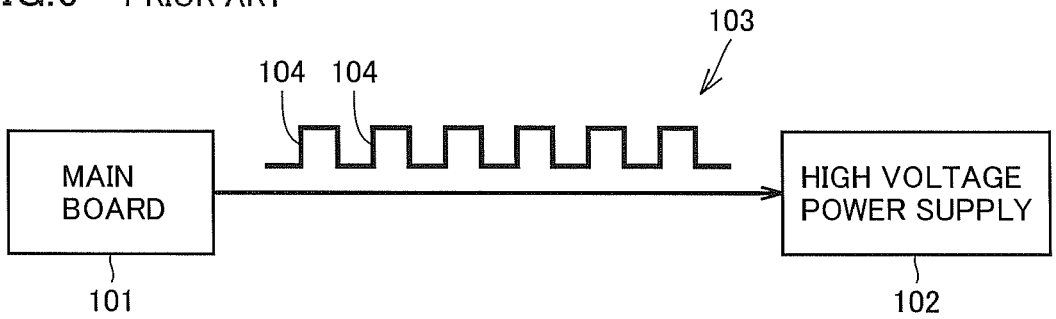
FIG.6 PRIOR ART
FIG. 6 is a conceptual diagram showing transmission of a square-wave signal.
Figure 7:
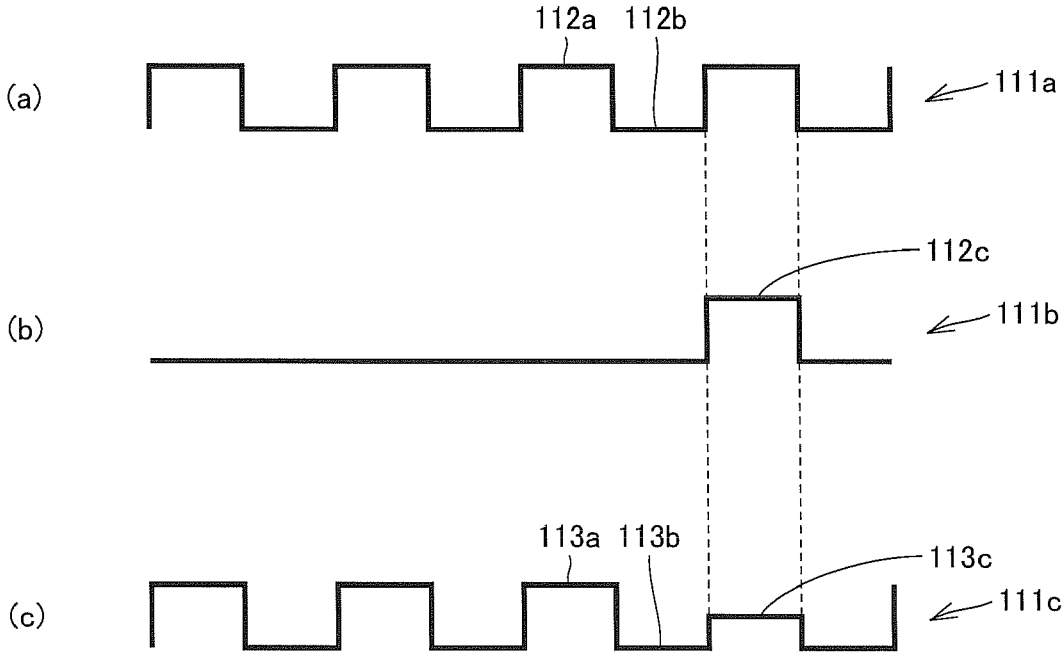
FIG.7 PRIOR ART
FIG. 7 illustrates (a) a first square-wave signal, (b) a second square-wave signal and (c) a voltage-controlling square-wave signal, respectively, which are output in a conventional manner.
Figure 8:
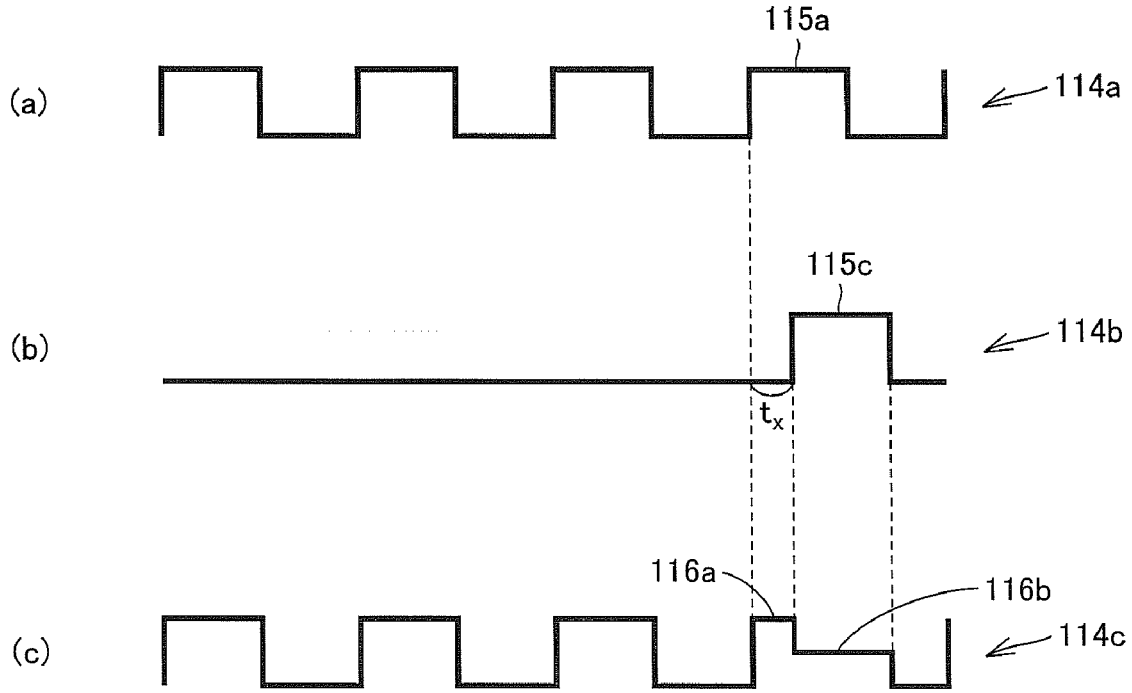
FIG.8 PRIOR ART
FIG. 8 illustrates (a) a first square-wave signal, (b) a second square-wave signal and (c) a voltage-controlling square-wave signal, respectively, which are output in the conventional manner, in the case where the rising edge of the second square-wave signal is delayed.

FIG. 4 is a flow chart illustrating the application of the developing bias voltage. FIG. 5(*a*) is a schematic view of a first square-wave signal, which corresponds to the aforementioned signal shown in FIG. 7(*a*). FIG. 5(*b*) is a schematic view of a second square-wave signal, which corresponds to the aforementioned signal shown in FIG. 7(*b*). FIG. 5(*c*) is a schematic view of a voltage-controlling square-wave signal for controlling developing bias voltage, which corresponds to the aforementioned signal shown in FIG. 7(*c*).

Referring to FIGS. 1 to 5, when a request to control the developing bias voltage is received (step S11 in FIG. 4, hereinafter "step" is omitted), the first square-wave signal 45*a* shown in FIG. 5(*a*) and the second square-wave signal 45*b* shown in FIG. 5(*b*) are firstly output (S12). The first square-wave signal 45*a* has a level 46*a* indicating the first level and a level 46*b* indicating the second level. The second square-wave signal 45*b* has a level 46*c* indicating the third level.

If a rising edge of the first square-wave signal 45*a* coincides with a rising edge of the second square-wave signal 45*b*, the second square-wave signal 45*b* is raised before the first square-wave signal 45*a* rises. Alternatively, if a falling edge of the first square-wave signal 45*a* coincides with a falling edge of the second square-wave signal 45*b*, the second square-wave signal 45*b* is dropped after the first square-wave signal 45*a* falls. More specifically, the time at which the second square-wave signal 45*b* in FIG. 5(*b*) rises to the level 46*c* is pushed forward by time $t_1$ with respect to the time at which the first square-wave signal 45*a* rises to the level 46*a*, while the time at which the second square-wave signal 45*b* falls from the level 46*c* is pushed back by time $t_2$ with respect to the time at which the first square-wave signal 45*a* falls from the level 46*a*.

Subsequently, a voltage-controlling square-wave signal 45*c* for controlling developing bias voltage is generated based on the first and second square-wave signals 45*a*, 45*b* (S13). The generated voltage-controlling square-wave signal 45*c* in FIG. 5(*c*) has a first level 47*a* corresponding to the level 46*a* of the first square-wave signal 45*a*, a second level 47*b* corresponding to the level 46*b* of the first square-wave signal 45*a* and a third level 47*c* corresponding to the level 46*c* of the second square-wave signal 45*b*. This voltage-controlling square-wave signal 45*c* is generated so as to synchronize the first square-wave signal 45*a* with the second square-wave signal 45*b*; however, the instruction given by the second square-wave signal 45*b* has higher priority than the instruction given by the first square-wave signal 45*a*.

The generated voltage-controlling square-wave signal 45*c* is output to the high voltage power supply 44 to apply developing bias voltage (S14).

As described above, when a rising edge of the first square-wave signal 45*a* coincides with a rising edge of the second square-wave signal 45*b*, the rising edge of the second square-wave signal 45*b* is advanced with respect to the rising edge of the first square-wave signal 45*a*, and when a falling edge of the first square-wave signal 45*a* coincides with a falling edge of the second square-wave signal 45*b*, the falling edge of the second square-wave signal 45*b* is delayed with respect to the falling edge of the first square-wave signal 45*a*. This can reduce the possibility of shaping the voltage-controlling square-wave signal 45*c* having the first level 47*a*, second level 47*b* and third level 47*c* into a unfavorable waveform, even though the rising edges and falling edges of the first and second square-wave signals are out of synchronization. Thus, the developing bias voltage can be properly controlled.

The developing units 26*a* to 26*d* and the multifunctional printer 10, which is provided with the developing bias control devices 41 capable of properly controlling developing bias voltage, can thus improve image quality.

Although, the controller provided in the multifunctional printer is adopted to control the operation of the developing bias control device in the aforementioned embodiment, the present invention is not limited thereto, and the developing bias control device can be designed to have its own controller therein that controls developing bias voltage.

In addition, the multifunctional printer in the aforementioned embodiment can include a level change unit that changes the first, second and third levels according to predetermined conditions. For example, the first, second and third levels are changed according to the degree of deterioration of a photo conductor and developer, which change over time, or the desired quality of images to be formed. The level change unit allows the multifunctional printer to form more appropriate images.

Although the control of the developing bias voltage is made by the voltage-controlling square-wave signal generated based on the first and second square-wave signals in the aforementioned embodiment, the present invention is not limited thereto, and the developing bias voltage can be directly controlled by the first and second square-wave signals without generating the voltage-controlling square-wave signal.

Although, in the aforementioned embodiment, each developing unit contained in the image forming section includes a developing sleeve and a magnetic roller as developer-supplying rotary components, the present invention is not limited thereto, and the developing unit can be a single-component developing unit including only a developing sleeve or a magnetic roller, or a two-component developing unit. In addition, it is possible to provide a developing sleeve and magnetic roller to one of the developing units. It is also possible to provide three or more developing sleeves, or three or more magnetic rollers to one of the developing units.

The foregoing has described the embodiment of the present invention by referring to the drawings; however, the invention should not be limited to the illustrated embodiment. It should be appreciated that various modifications and changes can be made to the illustrated embodiment within the scope of the appended claims and their equivalents.

What is claimed is:

1. A developing bias control device that controls developing bias voltage by a square-wave signal having a first level, a second level and a third level between said first and second levels, said developing bias control device comprising:

a first square-wave signal output unit that outputs a first square-wave signal instructing output of said first and second levels;

a second square-wave signal output unit that outputs a second square-wave signal instructing output of said third level, the instruction of said second square-wave signal having higher priority than that of said first square-wave signal; and a control unit that controls said first and second square-wave signal output units so as to advance a rising edge of said second square-wave signal with respect to a rising edge of said first square-wave signal when the rising edge of said first square-wave signal coincides with the rising edge of said second square-wave signal, and to delay a falling edge of said second square-wave signal with respect to a falling edge of said first square-wave signal when the falling edge of said first square-wave signal coincides with the falling edge of said second square-wave signal.

2. The developing bias control device according to claim 1 further comprising a voltage-controlling square-wave signal generation unit that generates a square-wave signal for controlling said developing bias voltage based on said first and second square-wave signals.

3. The developing bias control device according to claim 1 further comprising a level change unit that changes said first, second and third levels according to predetermined conditions.

4. The developing bias control device according to claim 1 further comprising a DAC (Digital Analog Converter) that converts digital signals into analog signals and outputs the converted signals, wherein said DAC outputs levels corresponding to said first, second and third levels.

5. A developing unit comprising:

a developing bias control device according to claim 1; and a developer-supplying rotary component that is controlled by said developing bias control device to supply developer.

6. The developing unit according to claim 5, wherein said developer-supplying rotary component is a developing sleeve that supplies developer to a photo conductor.

7. The developing unit according to claim 5, wherein said developer-supplying rotary component is a magnetic roller that supplies developer to the developing sleeve that supplies the developer to the photo conductor.

8. An image forming apparatus comprising an image forming section that forms images from image data, wherein said image forming section comprises a developing unit that forms images with developer, said developing unit comprises a developer-supplying rotary component that rotates to supply developer and a developing bias control device that controls developing bias voltage to be applied to said developer-supplying rotary component by a square-wave signal having a first level, a second level and a third level between said first and second levels, and said developing bias control device comprises:

a first square-wave signal output unit that outputs a first square-wave signal instructing output of said first and second levels;

a second square-wave signal output unit that outputs a second square-wave signal instructing output of said third level, the instruction of said second square-wave signal having higher priority than that of said first square-wave signal; and a control unit that controls said first and second square-wave signal output units so as to advance a rising edge of said second square-wave signal with respect to a rising edge of said first square-wave signal when the rising edge of said first square-wave signal coincides with the rising edge of said second square-wave signal, and to delay a falling edge of said second square-wave signal with respect to a falling edge of said first square-wave signal when the falling edge of said first square-wave signal coincides with the falling edge of said second square-wave signal.

9. A method for controlling developing bias voltage to be applied to a developer-supplying rotary component by a square-wave signal having a first level, a second level and a third level between said first and second levels, said developing bias control method comprising the steps of:

receiving a request to control developing bias voltage;

instructing output of said first and second levels by a first square-wave signal output from a first square-wave signal output unit;

instructing output of said third level by a second square-wave signal output from a second square-wave signal output unit, said instruction of said second square-wave signal having higher priority than that of said first square-wave signal;

controlling said first and second square-wave signal output units so as to advance a rising edge of said second square-wave signal with respect to a rising edge of said first square-wave signal when the rising edge of said first square-wave signal coincides with the rising edge of said second square-wave signal, and to delay a falling edge of said second square-wave signal with respect to a falling edge of said first square-wave signal when the falling edge of said first square-wave signal coincides with the falling edge of said second square-wave signal;

generating a voltage-controlling square-wave signal for controlling the developing bias voltage based on said first and second square-wave signals; and outputting the generated voltage-controlling square-wave signal to a high voltage power supply to apply the developing bias voltage.

* * * * *